United States Patent [19]

McCarty

[11] 4,412,108

[45] Oct. 25, 1983

[54] ELECTRICAL SWITCH AND ACTUATING MECHANISM THEREFOR

[75] Inventor: Patrick R. McCarty, New Cumberland, Pa.

[73] Assignee: AMP Incorporated, Harrisburg, Pa.

[21] Appl. No.: 327,666

[22] Filed: Dec. 7, 1981

[51] Int. Cl.[3] ..... H01H 19/00; H01H 21/00; H01H 23/00

[52] U.S. Cl. ..... 200/5 R; 200/6 R; 200/6 B; 200/16 R; 200/153 L; 200/302; 200/339

[58] Field of Search ..... 200/5 R, 5 A, 6 R, 6 B, 200/6 BA, 6 BB, 6 C, 16 R, 302, 303, 339

[56] References Cited

U.S. PATENT DOCUMENTS

| | | | |
|---|---|---|---|
| 2,275,510 | 3/1942 | Dietrich et al. | 200/153 |
| 2,925,481 | 2/1960 | Casey | 200/339 X |
| 3,121,778 | 2/1964 | Sander et al. | 200/172 |
| 3,171,007 | 2/1965 | Zavertnik | 200/168 |
| 3,689,723 | 9/1972 | Ludwig | 200/339 X |
| 3,737,604 | 6/1973 | Dietrich et al. | 200/153 LB |
| 4,018,999 | 4/1977 | Robinson et al. | 200/5 A |
| 4,259,552 | 3/1981 | Swann | 200/6 R |
| 4,311,884 | 1/1982 | Henley et al. | 200/302 X |
| 4,324,956 | 4/1982 | Sakakino et al. | 200/6 R X |
| 4,370,529 | 1/1983 | Loose | 200/5 R X |

*Primary Examiner*—J. R. Scott

*Attorney, Agent, or Firm*—Adrian J. LaRue

[57] ABSTRACT

A rocker-actuating mechanism comprises a housing having top and sides with openings in the sides that extend part way into the top. A bottom member is latchably secured to the housing. A rocker member is rockably mounted in the housing and includes pie-shaped members extending outwardly from the sides of the rocker member with apexes of the pie-shaped members and an apex of a top surface of the rocker member engaging the inside surface of the top of the housing thereby defining a pivot about which the rocker member rocks. Arcuate surfaces of the pie-shaped members are for engaging the bottom member when the rocker member is moved. Actuating arms extend outwardly from the rocker member and are disposed in the openings for actuating the rocker member. A spring-biased button is disposed in a cavity of the rocker member and moves along the bottom member. Stop surfaces on the rocker member engage the inside top surface of the housing to limit movement of the rocker member.

12 Claims, 3 Drawing Figures

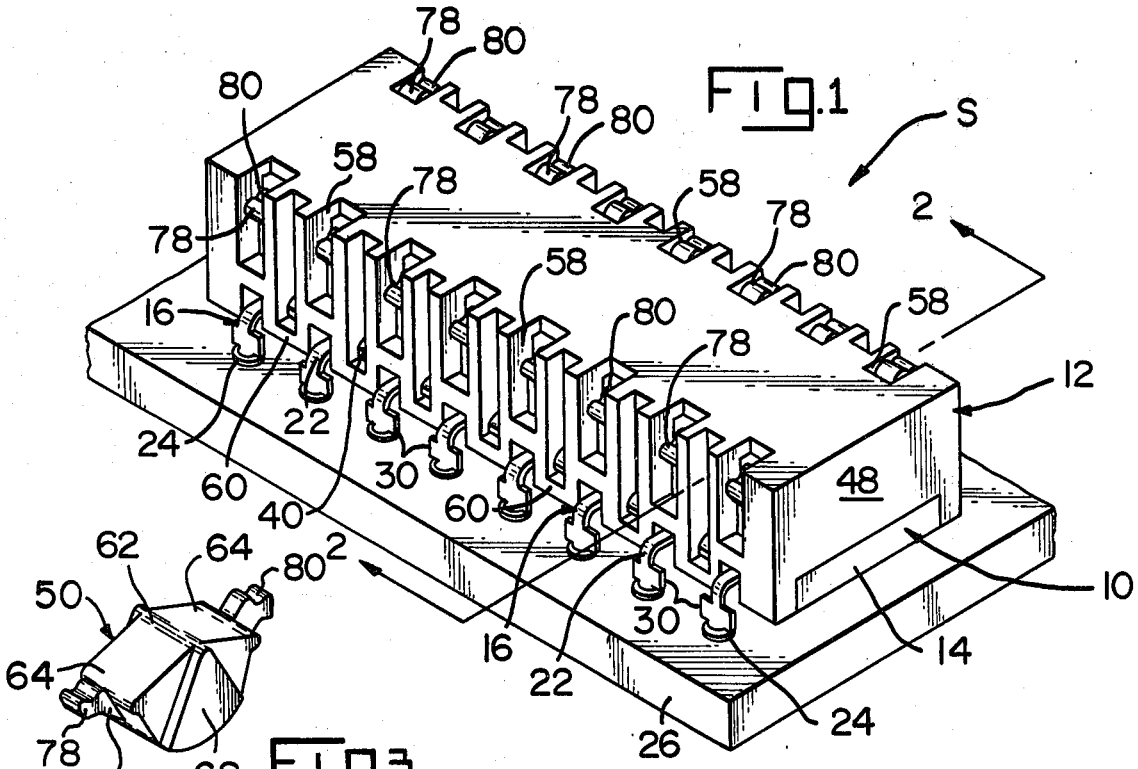
FIG. 1
FIG. 3
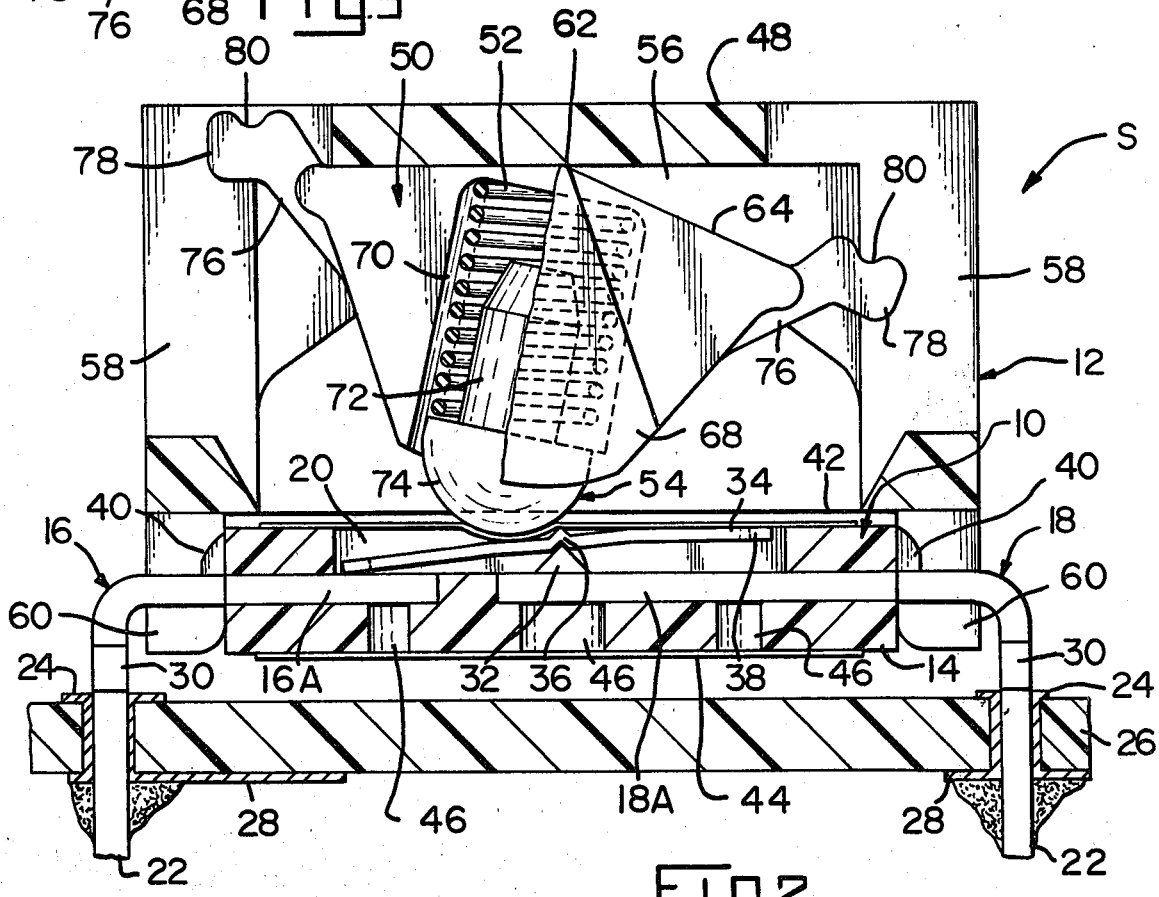
FIG. 2

ELECTRICAL SWITCH AND ACTUATING MECHANISM THEREFOR

FIELD OF THE INVENTION

This invention relates to an actuating mechanism and more particularly to an actuating mechanism for use with an electrical contact assembly or for operating a movable member.

BACKGROUND OF THE INVENTION

Dual in-line package switches are extensively used on printed circuit boards. These switches contain actuating mechanisms in top surfaces or side surfaces of the switch housings to enable use of a programming tool to position the actuating mechanisms from one position to another position.

The top-actuated actuating mechanisms do not permit actuation of the switches from the sides. Thus, they can only be actuated if the printed circuit board to which they are electrically connected is accessible for top actuation or the board removed to actuate them. No side actuation of these switches can be performed.

In the case of the side-actuated actuating mechanisms, they can be operated only from a side position and not from a top position.

SUMMARY OF THE INVENTION

According to the present invention, a rocker-actuating mechanism comprises a housing having top and sides with openings in the sides that extend part way into the top. A bottom member is latchably secured to the housing. A rocker member is rockably mounted in the housing and includes pie-shaped members extending outwardly from the sides of the rocker member with apexes of the pie-shaped members and an apex of a top surface of the rocker member engaging the inside surface of the top of the housing thereby defining a pivot about which the rocker member rocks. Arcuate surfaces of the pie-shaped members are for engaging the bottom member when the rocker member is moved. Actuating arms extend outwardly from the rocker member and are disposed in the openings for actuating the rocker member. A spring-biased button is disposed in a cavity of the rocker member and moves along the bottom member. Stop surfaces on the rocker member engage the inside top surface of the housing to limit movement of the rocker member.

According to another aspect of the present invention, the bottom member defines an electrical contact assembly including a dielectric frame in which aligned electrical contact members are secured with opposed stationary contact sections of the contact members being exposed within recesses in the top surface of the frame. Movable electrical contact members are pivotally mounted on one of the opposed stationary contact sections and spring-biased buttons of rocker members engage and move the movable contact members from operated to non-operated positions.

According to a further aspect of the present invention, membranes are sealingly secured onto the top and bottom surfaces of the dielectric frame thereby forming a sealed electrical contact assembly.

BRIEF DESCRIPTION OF THE DRAWINGS

FIG. 1 is a perspective view of an electrical switch using the actuating mechanism of the present invention.

FIG. 2 is a cross-sectional view partly broken away taken along line 2—2 of FIG. 1.

FIG. 3 is a perspective view of a rocker member.

DETAILED DESCRIPTION OF THE PREFERRED EMBODIMENT

FIGS. 1–3 illustrate the sealed electrical contact assembly 10 and the contact-actuating mechanism 12 that is latchably secured thereto thereby forming DIP switch S as illustrated in FIGS. 1 and 2.

Sealed electrical contact assembly 10 is completely disclosed in U.S. Patent Application Ser. No. 326,723 filed Dec. 2, 1981, which is incorporated by reference herein. Dielectric frame 14 is molded from a suitable commercially- available plastic material and it has a series of aligned electrical contact members 16, 18 molded in place therein. Electrical contact members 16, 18 are arranged in dielectric frame 14 having opposed stationary electrical contact sections 16A, 18A which are exposed in recesses 20 in the top surface of frame 14. Each of electrical contact members 16, 18 has an electrical terminal section 22 extending outwardly from frame 14 for electrical connection with electrical sockets 24 disposed in proper alignment in printed circuit board 26 with electrical sockets 24 electrically connected to appropriate circuit paths 28 located thereon. Electrical terminal sections 22 are provided with projections 30 to limit the movement of electrical terminal sections 22 within sockets 24 in order to space switch S from board 26. Electrical contact members 18 are provided with upwardly-directed pivot members 32 that have been stamped therefrom.

Moveable electrical contact members 34 have V-shaped embossments 36 formed therein which mate with pivot members 32 and the ends are provided with contact fingers 38 to provide contact redundancy when movable contact members 34 are moved into electrical contact with stationary contact sections 16A as illustrated in FIG. 2. V-shaped embossments 36 in engagement with pivot members 32 positively position movable contact members 34 relative to the respective sets of stationary contact sections 16A, 18A within recesses 20. Latching lugs 40 having beveled surfaces extend outwardly from the sides of frame 14 between terminal sections 22.

Membranes 42, 44 of a commerically-available plastic material are sealingly secured on the top and bottom surfaces of frame 14 by a commercially-available adhesive material. Membrane 42 covers all of recesses 20 with movable contact members 34 pivotally mounted on pivot members 32 of electrical contact sections 18A and membrane 44 covers holes 46 in frame 14. As can be discerned, membrane 42 not only maintains movable contact members 34 in position in recesses 20 and on pivot members 32 of stationary contact sections 18A, but membranes 42, 44 also seal electrical contact assembly 10 from contaminants, especially during which the flow soldering and cleaning operations the contact assembly will be subjected and during their operating life. While membrane 44 is disclosed as covering the bottom surface of frame 14 to cover holes 46 therein, frame 14 can be molded witout holes 46 therein thereby eliminating membrane 44 and using only membranes 42 adhered to the top surface of frame 14, if desired.

Contact-actuating mechanism 12 includes housing 48, rocker members 50, coil springs 52 and buttons 54. Housing 48, rocker members 50 and buttons 54 are molded from a commercially-available plastic material.

Housing 48 has separate cavities 56 which receive therein contact-actuating members comprising rocker members 50, coil springs 52 and buttons 54 therein as illustrated in FIG. 2. Openings 58 are located in the sides of housing 48 and terminate in the top of housing 48, opposing openings 58 communicate respectively with cavities 56. Latches 60 extend outwardly from the bottom surface of housing 48 to mate with latching lugs 40 on frame 14 to latchably secure housing member 48 onto frame 14 with the contact-actuating members in position in cavities 56 thereby forming switch S as illustrated in FIGS. 1 and 2.

Rocker members 50 have an apex 62 at the top of inclined surfaces 64 thereof which engage the inner surface of the top of housing 48. Inclined surfaces 66 of rocker members 50 engage the inside top surfaces of housing 48 to limit movement of rocker members 50 within cavities 56. Pie-shaped members 68 extend outwardly from each side of rocker members 50 and their apexes along with apex 62 of inclined surfaces 66 define pivot members to enable rocker members 50 to operate in a reciprocal manner within cavities 56 to operate contact assembly 10. The apexes of members 68 and apex 62 engage the upper inside surface of housing 48 to define a pivot point therefor and the bottom arcuate surfaces of members 68 rock along the membrane-covered top surface of frame 14 when rocker members 50 are moved from one position to another. Members 68 also stabilize movement of rocker members 50 within respective cavities 56 of housing 48.

Rocker members 50 have cavities 70 therein in which coil springs 52 and buttons 54 are disposed. Buttons 54 have a beveled shaft 72 disposed within coil springs 52 and a semi-spherical contact-operating member 74 that engages membrane 42 to operate movable contact members 34 as illustrated in FIG. 2 therethrough. Coil springs 52 extend between contact-operating members 74 and the bottom of cavities 70 thereby exerting pressure on contact-operating members 74 causing members 74 to springably engage membrane 42 and movable contact members 34 thereunder and to urge rocker members 50 against the upper inside surface of housing 48.

Actuating arms 76 extend outwardly from rocker members 50 and they have sections 78 with notches 80 therein disposed in respective openings 58.

In operation with reference to FIG. 2, a probe (not shown) is inserted into the left-sided notch 80 for applying a force to rocker member 50. This causes the bottom arcuate surfaces of members 68 to engage membrane 42 on the top surface of frame 14 thereby causing rocker member 50 to rock about such arcuate surfaces with contact-operating member 74 being depressed inwardly against the action of coil spring 52 as it rides along V-shaped embossment 36. So long as the force applied to rocker member 50 does not enable contact-operating member 74 to extend slightly beyond the center thereof, rocker member 50 will move back to its original position. If the operating force exerted by the probe is sufficient to move contact-operating member 74 via rocker member 50 beyond the center of contact-operating member 74, the configuration of embossment 37 on pivot member 32 and that of contact-operating member 74 plus the action of coil spring 52 will move rocker member 50 to the other position from where it was located thereby providing snap action operation. Engagement of embossment 36 by contact-operating member 74 through member 42 maintains rocker member 50 in position thereagainst. Fingers 38 of movable contact members 34 are wipingly moved along stationary contact section 16A because of the downwardly bent orientation of the section of the movable contact members that begins at a location spaced outwardly from embossments 36.

The construction of DIP switch S with membrane 42 in sealed engagement with the top surface of frame 14 or with membranes 42, 44 in sealed engagement with the top and bottom surfaces of frame 14 provides a DIP switch having a sealed electrical contact assembly that will protect the contact assembly from contaminants when the board 26 is subjected to conventional flow soldering and cleaning operations as well as during the normal operating life of the switch. The DIP switch S is also smaller in all dimensions than existing DIP switches thereby enabling it to be used in greater density at a lower profile. Switches S can be packaged in tubes in the manner of integrated circuits and subjected to automated insertion equipment. The sections 78 of actuating arms 76 in openings 58 enables top and side operation. Close mounting of switches S can be readily done on boards because the orientation of actuating arms 76 enable operation of the switches. The construction of switch S minimizes parts, molds to make them, and inventory. Switches S can readily be manufactured in accordance with the disclosure of the above-identified patent application.

I claim:

1. An actuating mechanism, comprising:

housing means having a top section and side sections, said side sections having openings therealong at spaced intervals, said openings extending inwardly into said top section, said openings in one of said side sections and said top section being in alignment with respective ones of said openings in the other of said side sections;

frame means connected to said housing means, said frame means having projection means;

actuating means mounted in said housing means at locations therealong where opposing openings in said side sections are located, said actuating means including rocker means and spring-biased means, said rocker means having pivot means, said spring-biased means extending between said frame means and said rocker means thereby urging said pivot means against an inner surface of said top section;

arm means extending outwardly from said rocker means and disposed in respective ones of the aligned openings, said arm means including section means disposed in said openings, said section means being engageable through said openings in said side sections or through said openings in said top section to move said rocker means from one position with said spring-biased means on one side of said projection means to another position thereby moving said spring-biased means to the other side of said projection means.

2. An actuating mechanism as set forth in claim 1, wherein said rocker means have cavity means therein, said spring-biased means disposed in said cavity means and including spring means and button means.

3. An actuating mechanism as set forth in claim 1, wherein inclined surfaces of said rocker means meet at an apex thereby forming said pivot means, said inclined surfaces engage said inner surface of said top section in the one or the other position thereby limiting movement of said rocker means.

4. An actuating mechanism as set forth in claim 1, wherein said frame meams is formed of dielectric material and has aligned stationary electrical contact means secured therein at intervals therealong corresponding to the locations of the aligned openings in said side sections and of said actuating means, recess means in an upper surface of said frame means in which spaced stationary contact section means of said stationary contact means are exposed, one of said stationary contact section means having pivot projection means, movable electrical contact means having V-shaped embossment means mating with respective ones of said pivot projection means within said recess means, said V-shaped embossment means and said pivot projection means defining said projection means, said spring-biased means engaging said movable contact means so that in said one position said movable contact means electrically engages said stationary contact section means and in said other position said movable contact means engages only said stationary contact section means containing said pivot projection means.

5. An actuating mechanism as set forth in claim 4 wherein membrane means is sealingly secured on said upper surface of said frame means, said spring-biased means engaging said movable contact means through said membrane means.

6. An electrical switch, comprising:

dielectric frame means having recess means disposed therealong in an upper surface thereof;

aligned electrical contact means mounted in said frame means at locations of said recess means including spaced stationary electrical contact section means exposed in said recess means, one of said contact section means having pivot projection means;

movable electrical contact means having V-shaped embossment means engaging said pivot projection means so that said movable contact means is moved between a first position for electrically connecting said electrical contact section means and to a second position electrically disconnecting said electrical contact section means, said embossment means maintaining said movable contact means on said pivot projection means and within said recess means;

housing means mounted on said frame means and including a top section and side sections, said side sections having aligned openings in alignment with respective ones of said recess means;

contact-actuating means mounted in said housing means in operative association with respective ones of said movable contact means, said contact-actuating means including movable means and contact-engaging means, said movable means movably mounted in said housing means for movement between said first position and said second position, said contact-engaging means comprising spring-biased means disposed in said movable means and in operative engagement with said movable contact means for moving said movable contact means to said first position or said second position when said movable means is moved to said first position or said second position; and arm means extending outwardly from said movable means and including section-engaging means disposed in respective ones of said aligned openings which when a force is applied to said section-engaging means from above or from the side will move said movable means to said first position or said second position.

7. An electrical switch as set forth in claim 6, wherein said frame means includes membrane means sealingly secured on said upper surface means, said spring-biased means engaging said movable contact means through said membrane means.

8. An electrical switch as set forth in claim 6, wherein said movable means comprise rocker means having inclined surfaces meeting at apex means thereby forming a pivot means about which said rocker means operates, said inclined surfaces engage an inner surface of said top section in the first or the second position thereby limiting movement of said rocker means.

9. An electrical switch as set forth in claim 8, wherein said rocker means have cavity means, said spring-biased means disposed in said cavity means and including spring means and button means, said spring means disposed between a bottom surface of said cavity means and said button means thereby urging said pivot means and one of said inclined surfaces of said rocker means against said inner surface in the first or second position and said button means into engagement with said movable contact means.

10. An electrical switch as set forth in claim 9, wherein said pivot means include pie-shaped means on each side of each of said rocker means having other apex means coincident with the apex means of said inclined surfaces and arcuate surface means for rocking movement along said frame means.

11. An electrical switch as set forth in claim 7, wherein other membrane means is sealingly secured to a bottom surface of said frame means.

12. An electrical switch as set forth in claim 6, wherein said aligned openings also extend into said top section.

* * * * *